US007517075B2

(12) United States Patent
Smith et al.

(10) Patent No.: US 7,517,075 B2
(45) Date of Patent: Apr. 14, 2009

(54) METHOD OF DETERMINING POWER APPLIED TO COMPONENT(S) OF AN IMAGE FORMING SYSTEM

(75) Inventors: David E. Smith, Vancouver, WA (US); Kenneth B. Wade, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 432 days.

(21) Appl. No.: 11/156,376

(22) Filed: Jun. 20, 2005

(65) Prior Publication Data

US 2006/0284949 A1 Dec. 21, 2006

(51) Int. Cl.
*B41J 29/38* (2006.01)
*B41J 2/01* (2006.01)

(52) U.S. Cl. ..... 347/102; 347/14; 347/17; 347/19; 700/286; 702/61; 346/25

(58) Field of Classification Search ..... None
See application file for complete search history.

(56) References Cited

U.S. PATENT DOCUMENTS 4,414,755 A * 11/1983 Ericsson ..... 34/245
4,459,469 A 7/1984 Ishima
4,564,749 A 1/1986 Ishima
4,567,353 A 1/1986 Aiba
4,590,362 A 5/1986 Ishima
4,660,057 A 4/1987 Watanabe et al.
5,329,295 A * 7/1994 Medin et al. ..... 346/25
5,349,905 A 9/1994 Taylor et al.
5,682,185 A 10/1997 Wade et al.
5,841,449 A 11/1998 Silverbrook
6,132,038 A * 10/2000 Szlucha ..... 347/102
6,278,909 B1 * 8/2001 Thibeault et al. ..... 700/286
6,428,160 B2 * 8/2002 Roy et al. ..... 347/102
6,669,324 B1 * 12/2003 King et al. ..... 347/19
6,787,050 B2 9/2004 Parish
6,976,752 B2 * 12/2005 Parish et al. ..... 347/57
2002/0149637 A1 10/2002 Miyakoshi et al.

* cited by examiner

*Primary Examiner*—Luu Matthew
*Assistant Examiner*—John P Zimmermann

(57) ABSTRACT

A method including attempting to provide a first amount of power to a component of an image forming system during a first time period and determining a second amount of power applied to the component during the first time period using a first power measurement made during the first time period and at least a second power measurement made during a second time period outside of the first time period is provided.

25 Claims, 4 Drawing Sheets

METHOD OF DETERMINING POWER APPLIED TO COMPONENT(S) OF AN IMAGE FORMING SYSTEM

BACKGROUND

Electrical systems generally receive power from a power supply. The electrical systems may include various components that draw various amounts of power from the power supply. Some components in an electrical system may operate as a function of the amount of power supplied to the component. Accordingly, these components may not operate properly in the system if the correct amount of power is not supplied to the components.

DETAILED DESCRIPTION

In the following detailed description of the embodiments, reference is made to the accompanying drawings, which form a part hereof, and in which is shown by way of illustration specific embodiments in which the present disclosure may be practiced. It is to be understood that other embodiments may be utilized and structural or logical changes may be made without departing from the scope of the present disclosure. The following detailed description, therefore, is not to be taken in a limiting sense.

Figure 1:
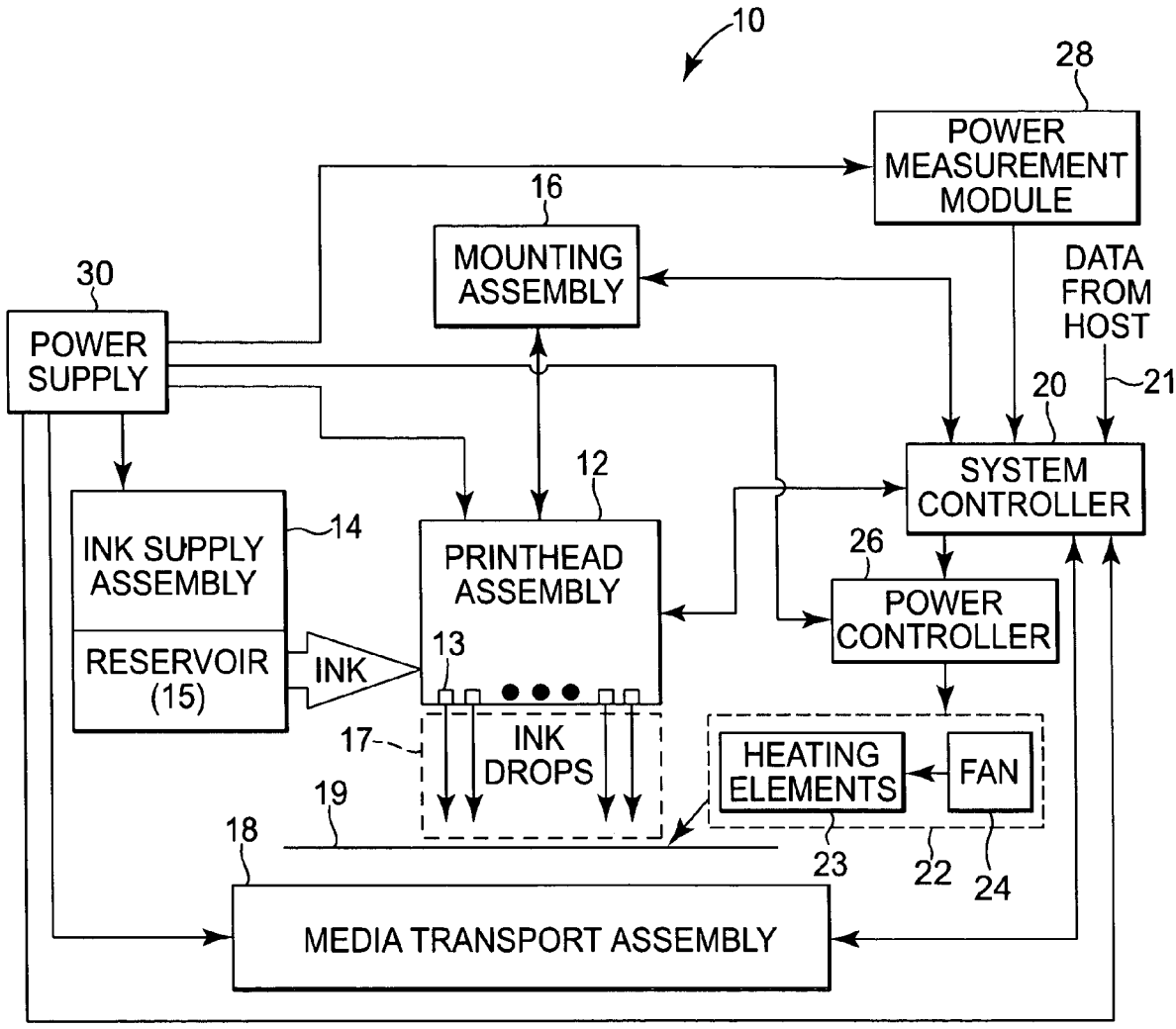
FIG. 1 is a block diagram illustrating an embodiment of an image forming system according to one embodiment of the present disclosure.

FIG. 1 illustrates one embodiment of an image forming system 10. Image forming system 10 constitutes one embodiment of a fluid ejection system which includes a fluid ejection assembly, such as an inkjet printhead assembly 12, and a fluid supply assembly, such as an ink supply assembly 14. In the illustrated embodiment, image forming system 10 also includes a mounting assembly 16, a media transport assembly 18, a system controller 20, a dryer 22, a power controller 26, a power measurement module 28, and a power supply 30.

Inkjet printhead assembly 12, as one embodiment of a fluid ejection assembly, includes one or more printheads or fluid ejection devices which eject drops of ink or fluid through a plurality of orifices or nozzles 13. In one embodiment, the drops are directed toward a medium, such as print medium 19, so as to print onto print medium 19. Print medium 19 is any type of suitable sheet material, such as paper, card stock, transparencies, Mylar, fabric, and the like. Typically, nozzles 13 are arranged in one or more columns or arrays such that properly sequenced ejection of ink from nozzles 13 causes, in one embodiment, characters, symbols, and/or other graphics or images to be printed upon print medium 19 as inkjet printhead assembly 12 and print medium 19 are moved relative to each other.

Ink supply assembly 14, as one embodiment of a fluid supply assembly, supplies ink to inkjet printhead assembly 12 and includes a reservoir 15 for storing ink. As such, in one embodiment, ink flows from reservoir 15 to inkjet printhead assembly 12. In one embodiment, inkjet printhead assembly 12 and ink supply assembly 14 are housed together in an inkjet or fluid-jet cartridge or pen. In another embodiment, ink supply assembly 14 is separate from inkjet printhead assembly 12 and supplies ink to inkjet printhead assembly 12 through an interface connection, such as a supply tube.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly and mounting assembly 16 includes a carriage for moving inkjet printhead assembly 12 relative to media transport assembly 18. In another embodiment, inkjet printhead assembly 12 is a non-scanning type printhead assembly and mounting assembly 16 fixes inkjet printhead assembly 12 at a prescribed position relative to media transport assembly 18.

System controller 20 communicates with inkjet printhead assembly 12, mounting assembly 16, and media transport assembly 18. System controller 20 receives data 21 from a host system, such as a computer, and may include memory for temporarily storing data 21. Data 21 may be sent to image forming system-10 along an electronic, infrared, optical or other information transfer path. Data 21 represents, for example, a document and/or file to be printed. As such, data 21 forms a print job for image forming system 10 and includes one or more print job commands and/or command parameters.

In one embodiment, system controller 20 provides control of inkjet printhead assembly 12 including timing control for ejection of ink drops from nozzles 13. As such, system controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of system controller 20 is located on inkjet printhead assembly 12. In another embodiment, logic and drive circuitry forming a portion of system controller 20 is located off inkjet printhead assembly 12.

Dryer 22 dries ink applied to print medium 19 by printhead assembly 12 by providing heat to print medium 19. More particularly, heating elements 23 generate heat in response to power supplied by power controller 26. Fan 24 blows air across heating elements 23 to transfer the heat from heating elements 23 onto print medium 19.

Power controller 26 provides power from power supply 30 to heating elements 23 and fan 24 of dryer 22 in response to control signals from system controller 20. By controlling the amount of time and the amount of power supplied to dryer 22, power controller 26 controls the amount of energy provided to dryer 22 for drying ink on print medium 19.

Power measurement module 28 measures the overall system power of image forming system 10. To do so, power measurement module 28 measures the voltage and current provided from power supply 30 to components in image forming system 10. Power measurement module 28 provides power measurements to system controller 20.

Power supply 30 supplies power to image forming system 10. In one embodiment, power supply 30 provides power to all or substantially all of the components of image forming system 10 including printhead assembly 12, ink supply assembly 14, media transport assembly 18, system controller 20, dryer 22, power controller 26, and power measurement module 28.

In one embodiment, power supply 30 provides a combination of AC power and DC power to the components of image forming system 10. In other embodiments, power supply 30 provides AC power but not DC power or DC power but not AC power to the components of image forming system 10.

As noted above, dryer 22 dries ink applied to print medium 19. Power controller 26 attempts to provide sufficient energy to dryer 22 to cause the ink on print medium 19 to be dried in order to efficiently control the energy consumption by image forming system 10. If power controller 26 does not cause enough energy to be applied to print medium 19, then the ink may not be fully dried and print medium 19 may emerge wet from image forming system 10. If power controller 26 causes too much energy to be applied to print medium 19, then energy may be inefficiently used.

System controller 20 determines the actual amount of power provided to dryer 22 by power controller 26 using overall system power measurements from power measurement module 28. By doing so, system controller 20 directs power controller 26 to cause power controller 26 to provide sufficient energy to dryer 22 to cause ink on print medium 19 to be dried without applying excessive energy to print medium 19.

Figure 2:
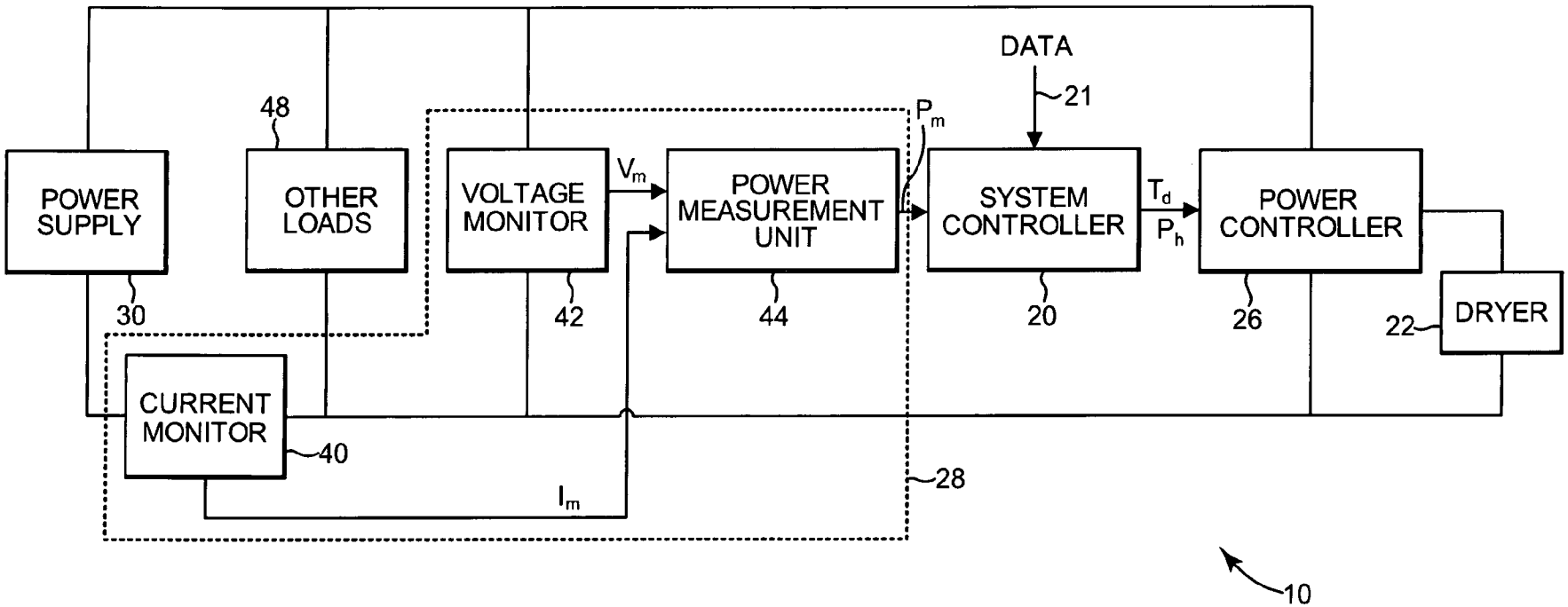
FIG. 2 is a block diagram illustrating additional details of the embodiment of image forming system of FIG. 1 according to one embodiment of the present disclosure.

FIG. 2 is a block diagram illustrating additional details of image forming system 10 of FIG. 1. In the embodiment of FIG. 2, power supply 30 supplies power to power controller 26. Power controller 26 regulates the amount of power provided to dryer 22 in response to control signals from system controller 20. Power supply 30 also supplies power to the remaining components of image forming system 10, shown as other loads 48. Although not fully shown on FIG. 2, the power drawn from power supply 30 by other loads 48 includes the power drawn by system controller 20 and power measurement module 28.

In the embodiment shown in FIG. 2, power management module 28 includes a current monitor 40, a voltage monitor 42, and a power measurement unit 44. Current monitor 40 measures the overall system current, $I_m$, drawn by image forming system 10 and provides overall system current measurements to power measurement unit 44. The overall system current includes the current drawn by power controller 26, dryer 22, and other loads 48. Voltage monitor 42 measures the overall system voltage, $V_m$, supplied to image forming system 10 and provides overall system voltage measurements to power measurement unit 44. The overall system voltage includes the voltage supplied in parallel across power controller 26 and other loads 48. Power measurement unit 44 calculates the overall system power, $P_m$, of image forming system 10 and provides the overall system power to system controller 20.

Figure 3:
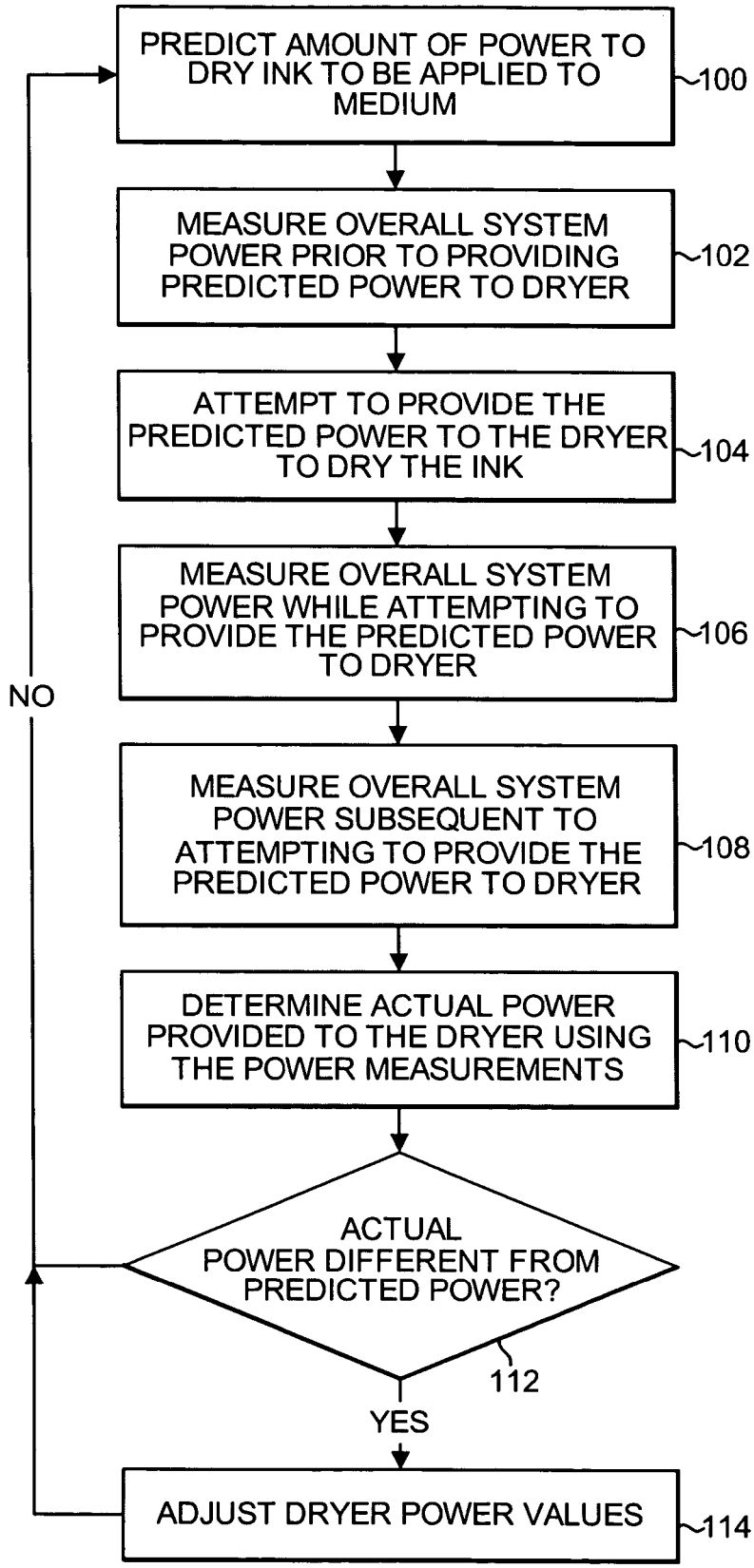
FIG. 3 is a flow chart illustrating an embodiment of a method for determining power usage of a component of an image forming system according to one embodiment of the present disclosure.

The operation of the embodiment shown in FIG. 2 will now be described with reference to the embodiment shown in FIG. 3. FIG. 3 is a flow chart illustrating one embodiment of a method for determining power usage of a component of image forming system 10. In the embodiment of the method described below, system controller 20 determines the power usage of dryer 22 using power measurements from power measurement module 28. In other embodiments, system controller 20 determines the power usage of one or more other components of image forming system 10 using power measurements from power measurement module 28.

In the embodiment shown in FIG. 3, system controller 20 predicts the amount of power to dry ink to be applied to print medium 19 as indicated in a block 100. In response to receiving data 21, system controller 20 determines the amount of ink that will be used to print at least a portion of an image associated with data 21. System controller 20 then predicts the amount of power, $P_h$, for drying the amount of ink on print medium 19 based on an amount of energy to be used to dry the amount of ink. In one embodiment, system controller 20 attempts to provide the predicted power, $P_h$, and an amount of time, $T_d$, for the power to be applied to dryer 22 to power controller 26.

In one embodiment, system controller 20 accesses information such as a table that indicates the amount of energy, power, and/or time for operating dryer 22 for various amounts of ink to be applied to print medium 19. In other embodiments, system controller 20 may calculate the amount of energy, power, and/or time for operating dryer 22 for various amounts of ink to be applied to print medium 19 according to various parameters or operating conditions of image forming system 10.

Power measurement module 28 measures the overall system power of image forming system 10 prior to attempting to provide the predicted power to dryer 22 as indicated in a block 102. Power measurement unit 44 receives an overall current measurement and an overall voltage measurement from current monitor 40 and voltage monitor 42, respectively, during a time period that is prior to power controller 26 attempting to provide the predicted power to dryer 22, i.e., while the dryer is not providing heat to dry ink on print medium 19. From the overall current and voltage measurements, power measurement unit 44 derives the overall system power measurement from the time period and provides the overall system power measurement to system controller 20. Because no or a relatively small amount of power is being provided to dryer 22 during this time period, the overall system power measurement provided from power measurement unit 44 to system controller 20 corresponds entirely, or at least substantially entirely, to other loads 48 and not dryer 22.

Power controller 26 attempts to provide the predicted power to dryer 22 to dry the ink as indicated in a block 104. Power controller 26 receives power from power supply 30 and attempts to provide an amount of power that is equal to the predicted power to dryer 22. The actual power provided to dryer 22 may vary from the predicted power due to variations in power supply 30, power controller 26, or other loads 48, for example.

Power measurement module 28 measures the overall system power of image forming system 10 while power controller 26 attempts to provide the predicted power to dryer 22 as indicated in a block 106. Power measurement unit 44 receives an overall current measurement and an overall voltage measurement from current monitor 40 and voltage monitor 42, respectively, during a time period that power controller 26 is attempting to provide the predicted power to dryer 22. From the overall current and voltage measurements, power measurement unit 44 derives the overall system power measurement from this time period and provides the overall system power measurement to system controller 20. Because power is being provided to dryer 22 during this time period, the overall system power measurement provided from power measurement unit 44 to system controller 20 corresponds to both dryer 22 and other loads 48.

Power measurement module 28 measures the overall system power of image forming system 10 subsequent to attempting to provide the predicted power to dryer 22 as indicated in a block 108. Power measurement unit 44 receives an overall current measurement and an overall voltage measurement from current monitor 40 and voltage monitor 42, respectively, during a time period that is subsequent to power controller 26 attempting to provide the predicted power to dryer 22, i.e., while the dryer is not providing heat to dry ink on print medium 19. From the overall current and voltage measurements, power measurement unit 44 derives the overall system power measurement from the time period and provides the overall system power measurement to system controller 20. Because no or a relatively small amount of power is being provided to dryer 22 during this time period, the overall system power measurement provided from power measurement unit 44 to system controller 20 corresponds entirely, or at least substantially entirely, to other loads 48 and not dryer 22.

Figure 4:
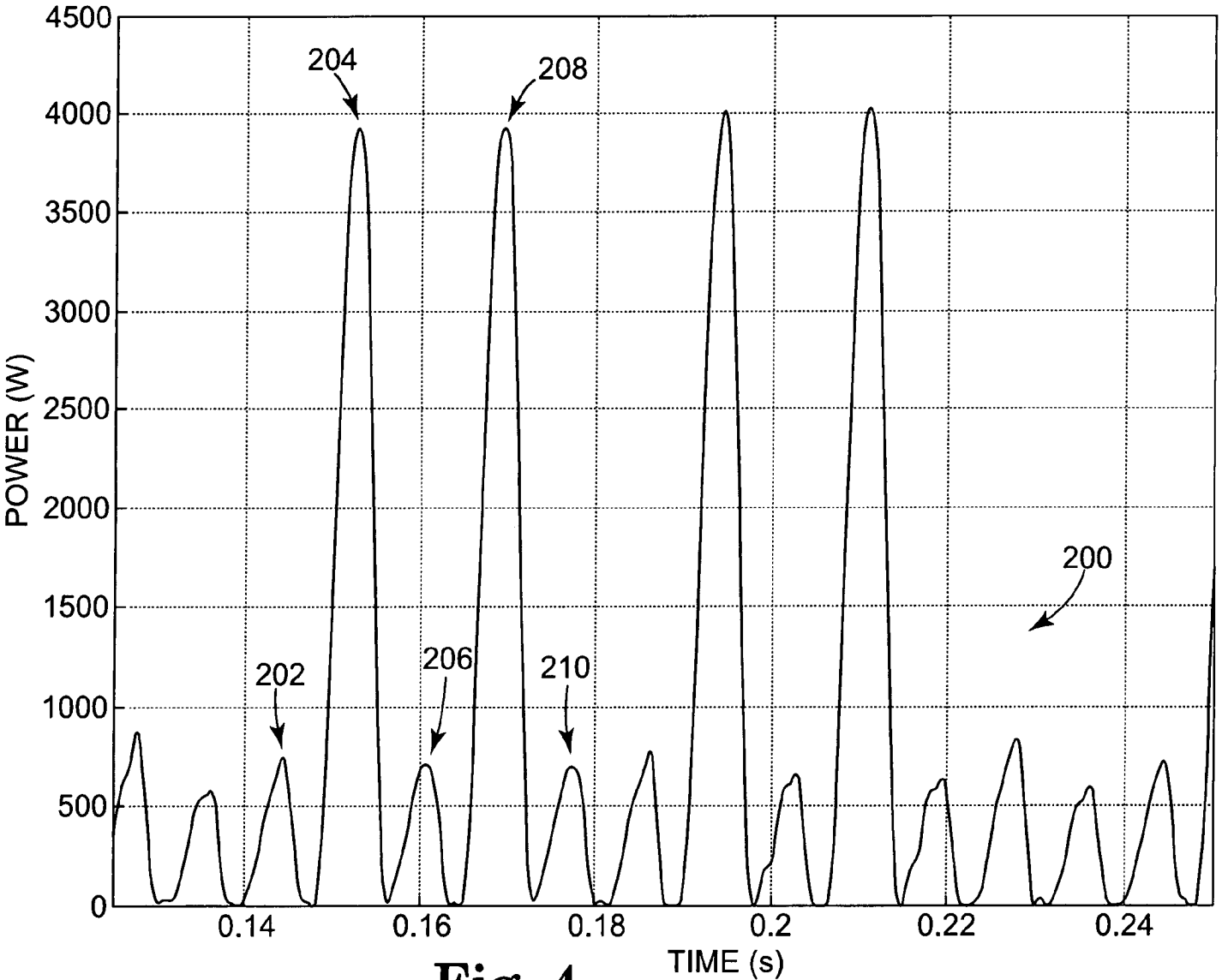
FIG. 4 is a graph illustrating an embodiment of power usage of an image forming system according to one embodiment of the present disclosure.

System controller 20 determines the actual power provided to dryer 22 using the overall system power measurements from blocks 102, 106, and 108 as indicated in a block 110. FIG. 4 is a graph 200 illustrating one embodiment of power usage of image forming system 10. In the example shown in FIG. 4, power measurement module 28 measures overall system power of image forming system 10 at points 202, 204, 206, 208, and 210 on graph 200.

In the example shown in FIG. 4, points 202, 206, and 210 represent overall system power measurements during time periods where dryer 22 is not providing heat to dry ink on print medium 19, i.e., dryer 22 is inactive. Points 204 and 208 represent overall system power measurements during time periods where dryer 22 is providing heat to dry ink on print medium 19, i.e., dryer 22 is active.

In one embodiment, system controller 20 subtracts an average of the overall system power measurements from time periods prior and subsequent to a time period where dryer 22 is active from an overall system power measurement from the time period where dryer 22 is active to determine the actual power provided to dryer 22 during a time period. For example, system controller 20 subtracts an average of the overall system power measurements at points 202 and 206 from the overall system power measurement at point 204 to determine the actual power provided to dryer 22 during the time period that includes point 204. As another example, system controller 20 subtracts an average of the overall system power measurements at points 206 and 210 from the overall system power measurement at point 208 to determine the actual power provided to dryer 22 during the time period that includes point 208.

In other embodiments, system controller 20 determines the actual power provided to dryer 22 during a time period using overall system power measurements from time periods prior and subsequent to the time period of the actual power in other ways.

In further embodiments, system controller 20 determines the actual power provided to dryer 22 during a time period using one or more overall system power measurements from one or more time periods that are prior or subsequent to the time period of the actual power. For example, system controller 20 determines the actual power provided to dryer 22 during the time period that includes point 208 using the overall system power measurement at point 206 or the overall system power measurement at point 210.

Referring back to FIG. 3, subsequent to determining the actual power provided to dryer 22 in block 110, a determination is made by system controller 20 as to whether the actual power provided to dryer 22 differs from the predicted power, attempted to be provided, as indicated in a block 112. In one embodiment, system controller determines that the actual power provided to dryer 22 differs from the predicted power if the difference between the actual power provided to dryer 22 and the predicted power exceeds a threshold amount.

If the actual power provided to dryer 22 differs from the predicted power, then system controller 20 adjusts power values associated with dryer 22 as indicated in a block 114. In one embodiment, the power values comprise the amount of energy, power, and/or time for operating dryer 22 for various amounts of ink to be applied to print medium 19. In another embodiment, the power values comprise parameters used to calculate the amount of energy, power, and/or time for operating dryer 22 for various amounts of ink to be applied to print medium 19.

Subsequent to the function of block 114 or if the actual power provided to dryer 22 does not differ from the predicted power as determined in block 112, system controller 20 repeats the function of block 100 for a next amount of ink. The next amount of ink may be associated with a next portion of an image or with a next image entirely.

Although specific embodiments have been illustrated and described herein for purposes of description of the embodiments, it will be appreciated by those of ordinary skill in the art that a wide variety of alternate and/or equivalent implementations may be substituted for the specific embodiments shown and described without departing from the scope of the present disclosure. Those with skill in the optical, mechanical, electromechanical, electrical, and computer arts will readily appreciate that the present disclosure may be implemented in a very wide variety of embodiments. This application is intended to cover any adaptations or variations of the preferred embodiments discussed herein. Therefore, it is manifestly intended that the claimed subject matter be limited only by the claims and the equivalents thereof.

What is claimed is:

1. A method comprising:

attempting to provide a predicted amount of power to a dryer of an image forming system during a first time period, the predicted amount of power corresponding to an amount of ink to be applied to a medium by the image forming system; and determining an actual amount of power applied to the dryer during the first time period using a first power measurement made during the first time period where power is being provided to the dryer and at least a second power measurement made during a second time period where power is not being provided to the dryer.

2. The method of claim 1 further comprising:

measuring a first system power provided to the dryer and at least one other component of the image forming system to make the first power measurement; and measuring a second system power provided to the dryer and the other component to make the second power measurement.

3. The method of claim 1 further comprising:

predicting the predicted amount of power in accordance with the amount of ink to be applied to the medium by the image forming system.

4. The method of claim 1 further comprising:

determining a difference between the first power measurement and the second power measurement to determine the actual amount of power.

5. The method of claim 1 further comprising:

determining the actual amount of power applied to the component during the first time period using the first power measurement, the second power measurement, and a third power measurement made during a third time period where power is not being provided to the dryer.

6. The method of claim 5 wherein the second power measurement is made prior to attempting to provide the predicted amount of power to the dryer, and wherein the third power measurement made is subsequent to attempting to provide the predicted amount of power to the dryer.

7. An apparatus comprising:

first circuitry configured to attempt to provide a predicted amount of power to a dryer of an image forming system during a first time period, the predicted amount of power corresponding to an amount of ink to be applied to a medium by the image forming system; and second circuitry configured to determine an actual amount of power applied to the dryer during the first time period using a first power measurement from the first time period where power is being provided to the dryer and at least a second power measurement from a second time period where power is not being provided to the dryer.

8. The apparatus of claim 7 wherein the second circuitry is configured to determine the amount of ink to be applied to the medium during the first time period, and wherein the second circuitry is configured to select the predicted amount of power in response to determining the amount of ink to be applied to the medium.

9. The apparatus of claim 7 further comprising:

third circuitry configured to measure a first system power provided to the dryer and at least one other component of the image forming system to generate the first power measurement and measure a second system power provided to the dryer and the other component of the image forming system to generate the second power measurement.

10. The apparatus of claim 7 where the second circuitry is configured to determine a difference between the first power measurement and the second power measurement to determine the actual amount of power.

11. The apparatus of claim 10 wherein the second circuitry is configured to adjust a plurality of power values in response to the difference exceeding a threshold.

12. An image forming system comprising:

means for attempting to provide a predicted amount of power to a dryer of the image forming system during a first time period, the predicted amount of power corresponding to an amount of ink to be applied to a medium by the image forming system; and means for determining an actual amount of power applied to the dryer during the first time period using a first power measurement from the first time period where power is being provided to the dryer and at least a second power measurement from a second time period where power is not being provided to the dryer.

13. The image forming system of claim 12 further comprising:

means for measuring a first system power provided to the dryer and at least one other component of the image forming system to generate the first power measurement and for measuring a second system power provided to the dryer and the other component of the image forming system to generate the second power measurement.

14. The image forming system of claim 12 further comprising:

means for predicting the predicted amount of power in accordance with the amount of ink to be applied to the medium by the image forming system.

15. The image forming system of claim 12 further comprising:

means for determining a difference between the first power measurement and the second power measurement to determine the actual amount of power.

16. The image forming system of claim 12 wherein the second time period is prior to the first time period.

17. The image forming system of claim 12 wherein the second time period is subsequent to the first time period.

18. An image forming system comprising:

at least one printhead configured to apply an amount of ink onto a medium during a first time period;

a dryer configured to apply heat to dry the amount of ink on the medium during the first time period; and a system controller configured to attempt to provide a predicted amount of power to the dryer during the first time period, the predicted amount of power corresponding to the amount of ink to be applied to the medium, and to determine an actual amount of power actually applied to the dryer during the first time period using a first power measurement made during the first time period where power is being provided to the dryer and at least a second power measurement made during a second time period where power is not being provided to the dryer.

19. The image forming system of claim 18 further comprising:

a power measure module configured to measure a first system power provided to the dryer and at least one other component of the image forming system during the first time period to generate the first power measurement and measure a second system power provided to the dryer and the other component of the image forming system during the second time period to generate the second power measurement.

20. The image forming system of claim 19 wherein the system controller is configured to determine the actual amount of power applied to the dryer during the first time period using the first power measurement, the second power measurement, and a third power measurement from a third time period where power is not being provided to the dryer.

21. The image forming system of claim 20 wherein the power measure module is configured to measure a third system power provided to the dryer and the other component of the image forming system during the third time period to generate the third power measurement.

22. The image forming system of claim 18 further comprising:

a power controller configured to provide the predicted amount of power to the dryer during the first time period responsive to the system controller.

23. The image forming system of claim 18 wherein the dryer comprises a heater and a fan configured to blow air across the heater.

24. A computer readable medium storing instructions for causing a computer to execute a method comprising:

attempting to provide a predicted amount of power to a dryer of an image forming system during a first time period, the predicted amount of power corresponding to an amount of ink to be applied to a medium by the image forming system; and determining an actual amount of power applied to the dryer during the first time period using a first power measurement made during the first time period where power is being provided to the dryer and at least a second power measurement made during a second time period where power is not being provided to the dryer.

25. The computer readable medium of claim 24 storing instructions for causing the computer to execute the method comprising:

predicting the predicted amount of power in accordance with the amount of ink to be applied to the medium by the image forming system.

* * * * *